US008855534B2

(12) United States Patent
Jung et al.

(10) Patent No.: US 8,855,534 B2
(45) Date of Patent: Oct. 7, 2014

(54) IMAGE FORMING APPARATUS AND POWER-TRANSMISSION ASSEMBLY OF THE SAME

(71) Applicant: Samsung Electronics Co., Ltd., Suwon-si (KR)

(72) Inventors: Tae Il Jung, Suwon-si (KR); Min Keun Song, Gangneung-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/679,269

(22) Filed: Nov. 16, 2012

(65) Prior Publication Data

US 2013/0164035 A1 Jun. 27, 2013

(30) Foreign Application Priority Data

Nov. 18, 2011 (KR) ..... 10-2011-0121147

(51) Int. Cl.
*G03G 15/00* (2006.01)
*G03G 21/18* (2006.01)

(52) U.S. Cl.
CPC ..... *G03G 15/5008* (2013.01); *G03G 21/186* (2013.01)
USPC ..... 399/167

(58) Field of Classification Search
CPC ..... G03G 21/185; G03G 21/2853; G03G 21/1857; G03G 21/186; G03G 21/1864; G03G 2221/1657; G03G 15/757
USPC ..... 399/167
See application file for complete search history.

(56) References Cited

U.S. PATENT DOCUMENTS

| | | | | |
|---|---|---|---|---|
| 6,397,029 | B1 * | 5/2002 | Portig | 399/167 |
| 7,155,145 | B2 * | 12/2006 | Iwasaki et al. | 399/167 |
| 8,270,876 | B2 * | 9/2012 | Morioka et al. | 399/167 |
| 2005/0191092 | A1 * | 9/2005 | Toso et al. | 399/167 |
| 2006/0018681 | A1 * | 1/2006 | Kim et al. | 399/167 |
| 2006/0062601 | A1 | 3/2006 | Jeong | |
| 2008/0260428 | A1 * | 10/2008 | Ueno et al. | 399/167 |

(Continued)

FOREIGN PATENT DOCUMENTS

| | | |
|---|---|---|
| EP | 0833226 | 4/1998 |
| EP | 2259156 | 12/2010 |

OTHER PUBLICATIONS

Extended European Search Report issued on May 26, 2014.

*Primary Examiner* — Clayton E Laballe
*Assistant Examiner* — Ruifeng Pu
(74) *Attorney, Agent, or Firm* — Stanzione & Kim, LLP

(57) ABSTRACT

An image forming apparatus having an improved power-transmission assembly to drive a developing cartridge mounted in a main body of the apparatus. The apparatus includes a main body, at least one driving coupling unit rotatably located in a side region of the main body, at least one driven coupling unit connected to a rotator inside a developing cartridge, and a coupling holder in which the driving and driven coupling units are connected to each other to enable a power-transmission from the driving coupling unit to the driven coupling unit. The driving coupling unit includes a first spherical portion to come into contact with one side of an inner surface of the coupling holder when received in the coupling holder. The driven coupling unit includes a second spherical portion to come into contact with the other side of the inner surface of the coupling holder when received in the coupling holder.

24 Claims, 8 Drawing Sheets

(56) References Cited

U.S. PATENT DOCUMENTS

2010/0061763 A1* 3/2010 Kim ..... 399/167
2010/0303503 A1* 12/2010 Woo ..... 399/167
2011/0081163 A1* 4/2011 Lee ..... 399/110
2011/0182623 A1* 7/2011 Tomatsu ..... 399/167
2011/0255900 A1* 10/2011 Zhou et al. ..... 399/111

* cited by examiner

IMAGE FORMING APPARATUS AND POWER-TRANSMISSION ASSEMBLY OF THE SAME

CROSS-REFERENCE TO RELATED APPLICATIONS

This application claims priority under 35 U.S.C. §119 from Korean Patent Application No. 2011-0121147, filed on Nov. 18, 2011 in the Korean Intellectual Property Office, the disclosure of which is incorporated herein by reference in its entirety.

BACKGROUND OF THE INVENTION

1. Field of the Invention

Embodiments of the present general inventive concept relate to an image forming apparatus having a power-transmission assembly including couplings, and the power-transmission assembly of the image forming apparatus.

2. Description of the Related Art

Generally, image forming apparatuses are devised to form an image on a printing medium according to input signals. Examples of image forming apparatuses include printers, copiers, fax machines, and devices combining functions thereof.

One type of image forming apparatuses is an electro-photographic image forming apparatus that includes a developing cartridge in which a photoconductor and a developing device are received, and a light scanning unit. The light scanning unit forms an electrostatic latent image on a surface of the photoconductor by irradiating light to the photoconductor that has been charged with a predetermined electric potential. The developing device forms a visible image by supplying developer to the photoconductor on which the electrostatic latent image has been formed.

The photoconductor and developing roller, for example, included in the developing cartridge are driven upon receiving drive power, required to form an image, from a drive source provided in a main body of the image forming apparatus in a state in which the developing cartridge is mounted in the main body. Couplings are generally used to transmit drive power of the drive source provided in the main body to the photoconductor and developing roller included in the developing cartridge.

Once the developing cartridge has been mounted in the main body, a driving coupling provided in a side region of the main body is coupled to a driven coupling provided in a side region of a developing cartridge to transmit drive power of the drive source to the driven coupling. The photoconductor and developing roller, which are connected to the driven coupling, are rotated upon receiving the drive power, forming an image.

However, in the above-described configuration, if the driving coupling and driven coupling are dislocated, power-transmission from the driving coupling to the driven coupling may be problematic to cause a negative effect on durability of the couplings.

SUMMARY OF THE INVENTION

The present general inventive concept provides an image forming apparatus having an improved power-transmission assembly to drive a developing cartridge mounted in a main body of the image forming apparatus.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an image forming apparatus including a main body, at least one driving coupling unit located in a side region of the main body, the driving coupling unit being rotated by a drive power generated from a drive source, at least one driven coupling unit connected to a rotator inside a developing cartridge mounted in the main body, and a coupling holder in which the driving coupling unit and the driven coupling unit are received and connected to each other to enable transmission of a rotation power from the driving coupling unit to the driven coupling unit, wherein the driving coupling unit includes a first spherical portion configured to come into contact with one side of an inner surface of the coupling holder when received in the coupling holder, and wherein the driven coupling unit includes a second spherical portion configured to come into contact with the other side of the inner surface of the coupling holder when received in the coupling holder.

The first spherical portion and the second spherical portion may have the same outer diameter.

The coupling holder may be rotated about a virtual axis that connects a center of the first spherical portion and a center of the second spherical portion during rotation of the driving coupling unit.

A distance between a center of the first spherical portion and a center of the second spherical portion may be shorter than an axial length of the inner surface of the coupling holder.

The driving coupling unit may include at least one first protrusion to radially protrude from a spherical surface of the first spherical portion, and the coupling holder may include a raised portion stepped inward of the inner surface of the coupling holder so as to be caught by the at least one first protrusion, in order to prevent the coupling holder from being separated from the driving coupling unit during rotation of the driving coupling unit.

The driven coupling unit may include at least one second protrusion to radially protrude from a spherical surface of the second spherical portion, and the coupling holder may include at least one receiving recess having a shape corresponding to the at least one second protrusion to receive the at least one second protrusion, in order to ensure that the driving coupling unit and the driven coupling unit are rotatable at the same angular velocity.

The at least one second protrusion may include at least two second protrusions arranged in a circumferential direction of the second spherical portion, and the receiving recess may be arranged in a circumferential direction of the inner surface of the coupling holder such that the at least two second protrusions are received in the receiving recess.

The image forming apparatus may further include an elastic member configured to come into contact with the coupling holder so as to axially press the coupling holder.

The image forming apparatus may further include a rotating shaft coupled to the driving coupling unit to rotate the driving coupling unit, and the rotating shaft may include a support portion formed at an outer circumferential surface thereof to support one end of the elastic member.

The first spherical portion may include a first cut surface facing the second spherical portion, and the second spherical portion may include a second cut surface facing the first cut surface, and a sum of the shortest distance between a center of the first spherical portion and the first cut surface and the shortest distance between a center of the second spherical portion and the second cut surface may be shorter than a distance between the center of the first spherical portion and the center of the second spherical portion.

The rotator may include a developing roller.

The rotator may include a photoconductor.

The foregoing and/or other features and utilities of the present general inventive concept may also be achieved by providing a power-transmission assembly of an image forming apparatus, including at least one driving coupling unit to rotate about a first axis upon receiving a drive power generated from a drive source mounted in a main body of the image forming apparatus, at least one driven coupling unit connected to a rotator inside a developing cartridge mounted in the main body, the driven coupling unit being adapted to rotate about a second axis upon receiving a rotation power of the driving coupling unit, a coupling holder including a cylindrical portion in which the driving coupling unit and the driven coupling unit are received and connected to each other to achieve the same rotation angular velocity of the driving coupling unit and the driven coupling unit even if the first axis and the second axis do not coincide with each other, and an elastic member to axially press the coupling holder so as to regulate relative positions of the coupling holder, the driving coupling unit and the driven coupling unit in a state in which the driving coupling unit and the driven coupling unit are received in the cylindrical portion.

The driving coupling unit may include a first spherical portion configured to come into contact with one side of an inner surface of the cylindrical portion when received in the cylindrical portion, and the driven coupling unit may include a second spherical portion configured to come into contact with the other side of the inner surface of the cylindrical portion when received in the cylindrical portion.

The first spherical portion and the second spherical portion may respectively include a first cut surface and a second cut surface facing each other, and a sum of the shortest distance between a center of the first spherical portion and the first cut surface and the shortest distance between a center of the second spherical portion and the second cut surface may be shorter than a distance between the center of the first spherical portion and the center of the second spherical portion.

The first spherical portion and the second spherical portion may have the same outer diameter.

A distance between a center of the first spherical portion and a center of the second spherical portion may be shorter than an axial length of the cylindrical portion.

The driving coupling unit may include at least one first protrusion radially protruding from a spherical surface of the first spherical portion, and the coupling holder may include a raised portion stepped inward of the inner surface of the cylindrical portion so as to be caught by the at least one first protrusion.

The driven coupling unit may include at least one second protrusion radially protruding from a spherical surface of the second spherical portion, and the coupling holder may include at least one receiving recess having a shape corresponding to the at least one second protrusion to receive the at least one second protrusion.

The cylindrical portion may include a chamfer to assist the driven coupling unit in being smoothly received in the cylindrical portion.

The foregoing and/or other features and utilities of the present general inventive concept may also be achieved by providing an image forming apparatus including a main body and a developer cartridge installed in the main body, a driving coupling unit disposed on a side region of the main body, the driving coupling unit being rotated about a first rotation center line by a drive power generated from a drive source, a driven coupling unit disposed on the developer cartridge and having a second rotation center line, a coupling holder to connect the driving coupling unit and the driven coupling unit when the developer cartridge is installed in the main body, and to transmit the drive power from the driving coupling unit to the driven coupling unit when the first center line and the second center line are not disposed on a same line.

The image forming apparatus may further include a first coupling element formed to fixedly couple the driving coupling unit and the coupling holder, and a second coupling element formed to movable couple the driven coupling unit and the coupling holder.

The driven coupling unit of the developer cartridge may include a rotation shaft and a spherical portion forming on a distal end of the rotation shaft to be inserted into the coupling holder, and the spherical portion of the driven coupling unit may be moveably coupled to the coupling holder to allow a movement of the second rotation center within the coupling holder during the transmission of the drive power.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
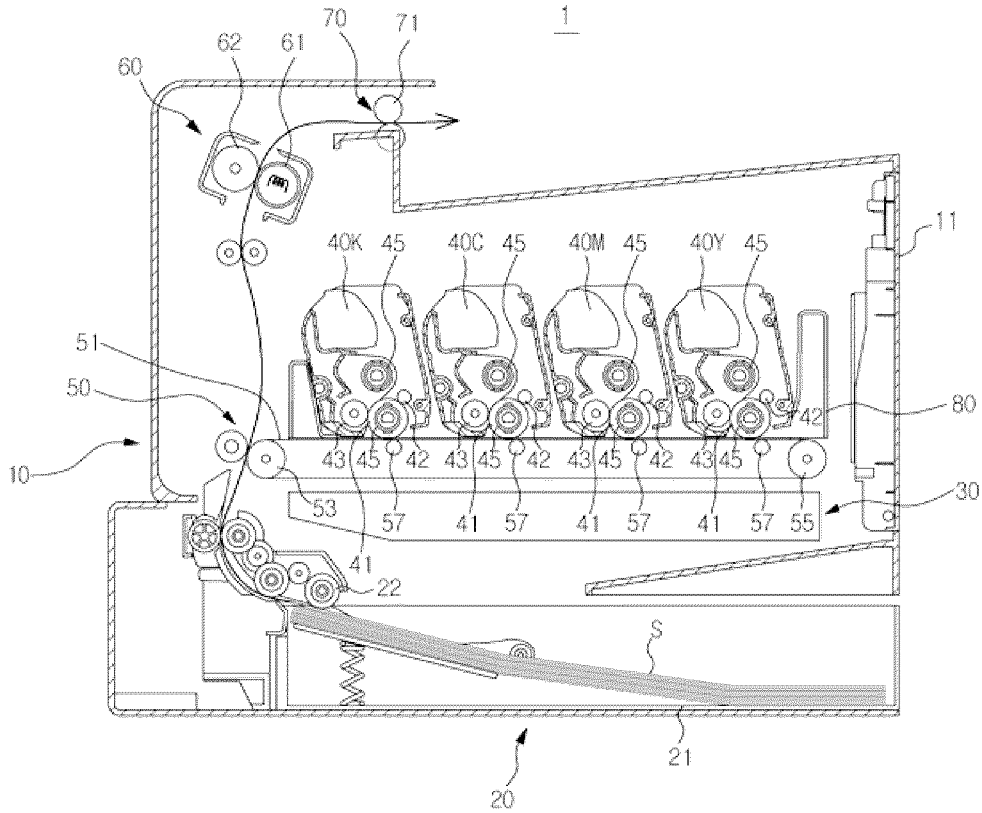
FIG. 1 is a view schematically illustrating an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

FIG. 1 is a view schematically illustrating an image forming apparatus 1 according to an embodiment of the present general inventive concept.

As illustrated in FIG. 1, the image forming apparatus 1 includes a main body 10, a printing media feeding unit 20, a light scanning unit 30, a developing cartridge 40, a transfer unit 50, a fixing unit 60, and a printing media discharge unit 70.

The main body 10 defines an external appearance of the image forming apparatus 1 and supports a variety of elements received therein. A main body cover 11 is pivotally rotatably coupled to one side of the main body 10. The main body cover 11 is configured to open or close a partial region of the main body 10. As such, a user may access the interior of the main body 10 to attach or detach the internal elements, such as the developing cartridge 40.

The printing media feeding unit 20 includes a cassette 21 in which printing media S is stored, a pickup roller 22 to pick up the printing media S stored in the cassette 21 one by one, and a delivery roller 23 to deliver each picked printing medium toward the transfer unit 50.

The light scanning unit 30 is placed below the developing cartridge 40 and serves to form an electrostatic latent image on a surface of a photoconductor 41 by irradiating light corresponding to image information to the photoconductor 41.

The developing cartridge 40 may include one or more developing cartridges, for example, four developing cartridges 40Y, 40M, 40C and 40K, in which different colors of developers, for example, yellow (Y), magenta (M), cyan (C), and black (K) developers are received respectively.

Each of the developing cartridges 40Y, 40M, 40C and 40K includes the photoconductor 41, a charging roller 42, a developing roller 43, and a feed roller (not illustrated). An electrostatic latent image is formed on a surface of the photoconductor 41 by the light scanning unit 30. The charging roller 42 charges the photoconductor 41 with a predetermined electric potential. The feed roller (not illustrated) feeds developer to the developing roller 43. The developing roller 43 attaches the developer to the surface of the photoconductor 41 on which the electrostatic latent image has been formed, so as to form a visible image. Additionally, driven couplings 45 are provided in a side region of the respective developing cartridges 40Y, 40M, 40C and 40K so as to be connected to and rotated by driving couplings (110, see FIG. 3) placed in a side region of the main body 10 in a state in which the photoconductors 41 and the developing rollers 43 of the respective developing cartridges 40Y, 40M, 40C and 40K are mounted in the main body 10.

The transfer unit 50 includes a transfer belt 51 that circulates in contact with the photoconductors 41 of the respective developing cartridges 40Y, 40M, 40C and 40K, a drive roller 53 to drive the transfer belt 51, a tension roller 55 to apply constant tension to the transfer belt 51, and four rollers 57 to transfer visible images developed on the photoconductors 41 of the respective developing cartridges 40Y, 40M, 40C and 40K to the printing medium P.

The fixing unit 60 includes a heating roller 61 containing a heat source, and a pressure roller 62 installed to face the heating roller 61. When the printing medium passes between the heating roller 61 and the pressure roller 62, the image is fixed to the printing medium by heat transmitted from the heating roller 61 and pressure applied between the heating roller 61 and the pressure roller 62.

The printing media discharge unit 70 includes a plurality of discharge rollers 71 to discharge the printing medium having passed through the fixing unit 60 to the outside of the main body 10.

The respective developing cartridges 40Y, 40M, 40C and 40K to form the image are mounted in the main body 10 while being received in a tray 80 that is slidably coupled to the main body 10. The developing cartridges 40Y, 40M, 40C and 40K mounted in the main body 10 are driven upon receiving drive power from a drive source, such as a drive motor (not shown), provided in the main body 10.

Figure 2:
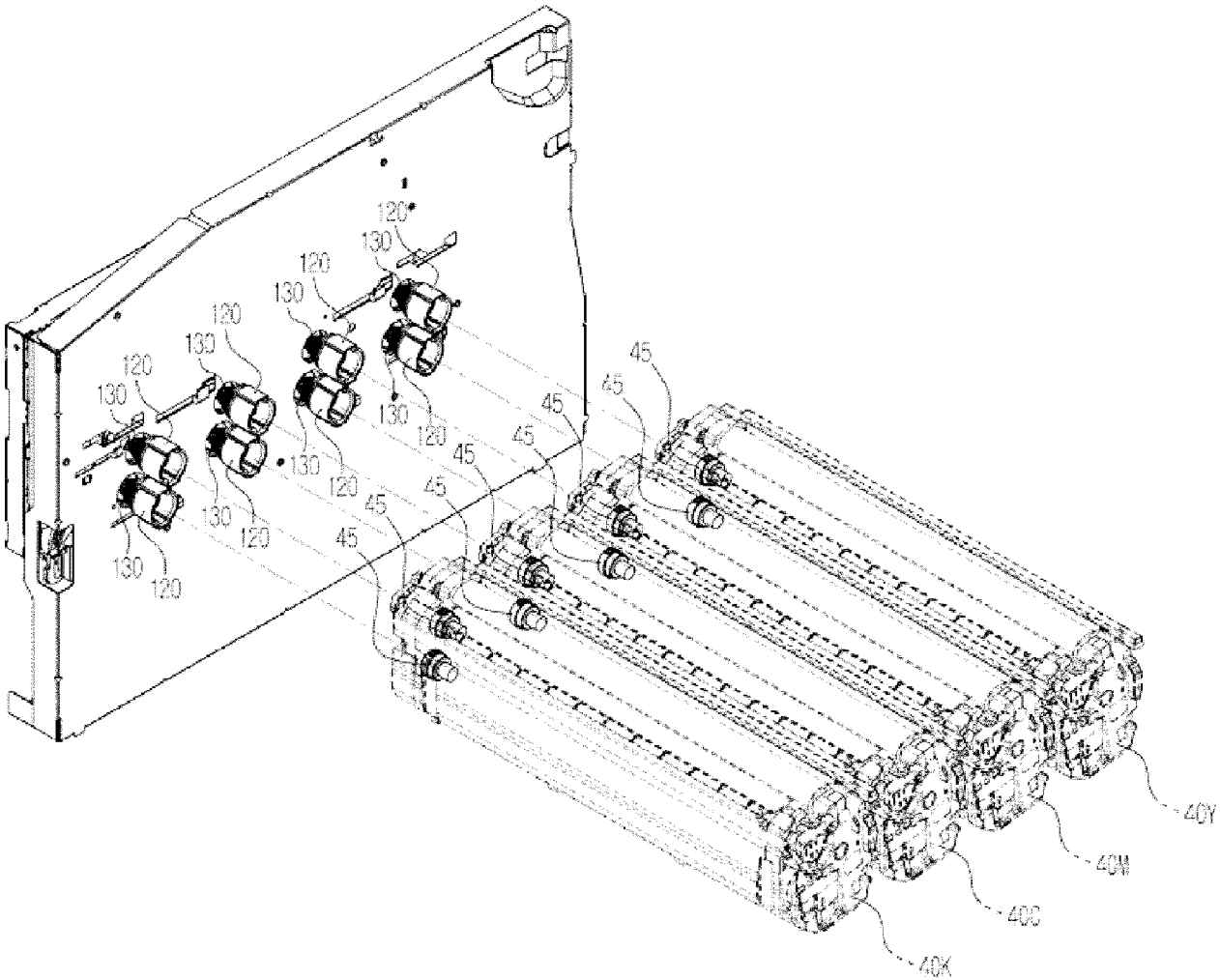
FIG. 2 is a view illustrating a power-transmission assembly to drive the developing cartridge in the image forming apparatus of FIG. 1 according to an embodiment of the present general inventive concept.
Figure 3A:
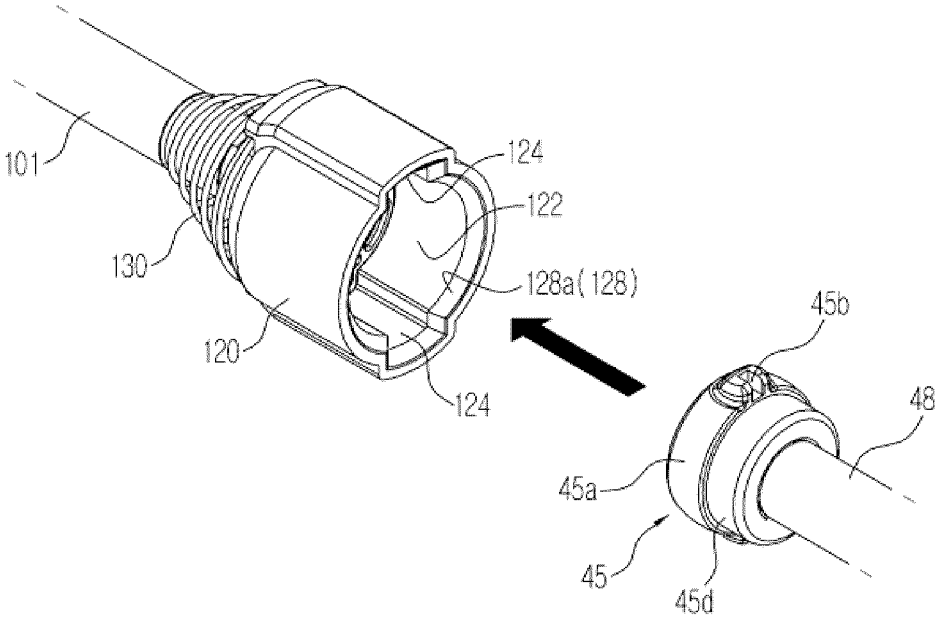
FIGS. 3A and 3B are views illustrating a driving coupling, driven coupling, and coupling holder of the power-transmission assembly of FIG. 2.
Figure 3B:
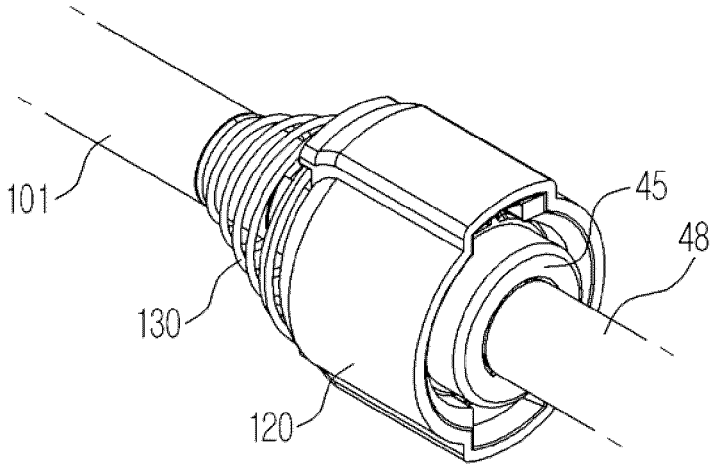
Figure 4:
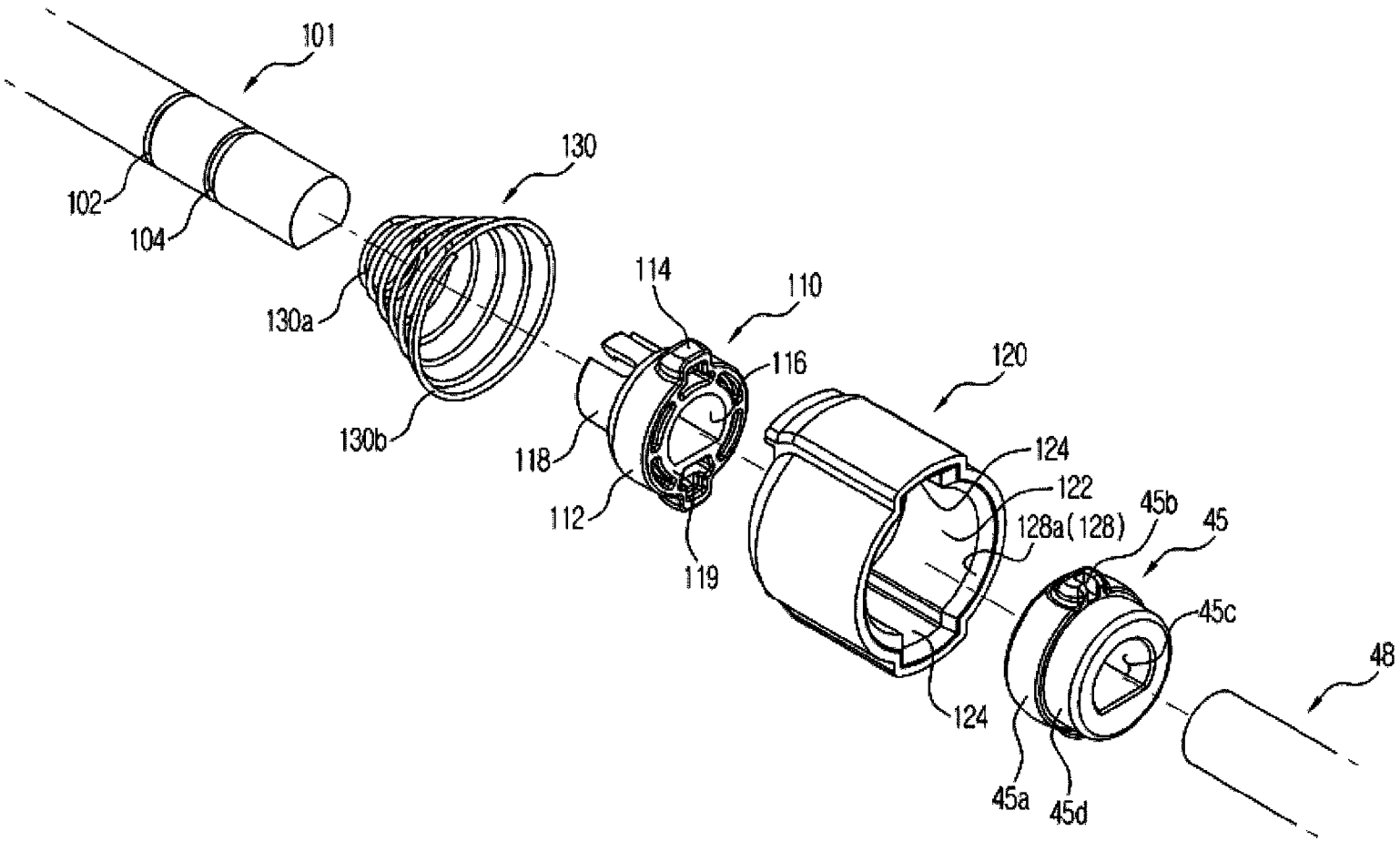
FIG. 4 is an exploded perspective view illustrating the power-transmission assembly of FIG. 2.

FIG. 2 is a view illustrating a power-transmission assembly to drive the developing cartridge in the image forming apparatus 1 of FIG. 1 according to an embodiment of the present general inventive concept, FIGS. 3A and 3B are views illustrating a driving coupling unit 110, a driven coupling unit 45, and a coupling holder 120 of the power-transmission assembly of FIG. 2, and FIG. 4 is an exploded perspective view illustrating the power-transmission assembly of FIG. 2.

As illustrated in FIGS. 2, 3A, 3B, and 4, the image forming apparatus 1 according to the embodiment of the present general inventive concept includes a power-transmission assembly including the driving coupling units 110 which are located in a side region 10*a* of the main body 10 and are rotated by a drive power generated from the drive source (not illustrated), such as a drive motor, the driven coupling units 45 which are connected to the corresponding photoconductors 41 and developing rollers 43 within the respective developing cartridges 40Y, 40M, 40C and 40K mounted in the main body 10, coupling holders 120 in which the driving coupling units 110 and the corresponding driven coupling units 45 are received and connected to each other such that rotation power of the driving coupling units 110 is transmitted to the corresponding driven coupling units 45, and elastic members 130 to press the corresponding coupling holders 120.

The driving coupling units 110 are movable in a rotation center direction (I1, see FIG. 6) by a variety of link devices (not illustrated) placed in the main body 10 so as to be connected to the corresponding driven coupling units 45 in a state in which the developing cartridges 40Y, 40M, 40C and 40K are mounted in the main body 10. Each of the driving coupling units 110 includes a first spherical portion 112 which takes the form of a partially-cut sphere to reduce the size of the driving coupling unit 110, one or more first protrusions 114 which radially protrude from a spherical surface of the first spherical portion 112, a first through-hole 116 perforated in a center of the driving coupling unit 110, through which a first rotating shaft 101 connected to the drive source (not illustrated) is rotatably fitted, and a first fixing portion 118 to fix the driving coupling unit 110 to the first rotating shaft 101.

The first spherical portion 112 may come into contact with one side of an inner surface of a cylindrical portion 122 of the coupling holder 120 in a state in which the driving coupling 110 is received in the coupling holder 120. The first spherical portion 112 controls or supports the driving coupling 110 to rotate with a degree of freedom inside the inner surface of the cylindrical portion 122 when the rotation center (I1, see FIG. 6) of the driving coupling unit 110 and a rotation center (I2, see FIG. 6) of the driven coupling unit 45 are not parallel or when the rotation center (I1, see FIG. 7) of the driving coupling unit 110 and the rotation center (I2, see FIG. 7) of the driven coupling unit 45 are offset from each other. In this way, connections between the driving coupling unit 110, the driven coupling unit 45 and the coupling holder 120 are maintained during power transmission.

The first protrusion 114 may be caught by a raised portion 123 formed at the cylindrical portion 122 of the coupling holder 120 to prevent the coupling holder 120 from being separated from the driving coupling 110 when the driving coupling 110 rotates upon receiving power from the drive source (not shown). At least two first protrusions 114 may be arranged in a circumferential direction of the first spherical portion 112.

One end 118*a* of the first fixing portion 118 is fixed to and supported by a first support portion 102 formed at an outer circumferential surface of the first rotating shaft 101 in a state in which the driving coupling 110 is coupled to the first rotating shaft 101. As illustrated in FIG. 4, the support portion 102 may be a circumferential groove formed in the outer circumferential surface of the first rotating shaft 101.

The driven coupling units 45 are exposed from one side of the developing cartridges 40Y, 40M, 40C and 40Y so as to be connected to the corresponding driving coupling units 110. Each of the driven coupling units 45 includes a second spherical portion 45*a* which takes the form of a partially-cut sphere to reduce the size of the driven coupling 45, one or more second protrusions 45*b* which radially protrude from a spherical surface of the second spherical portion 45*a*, a second through-hole 45*c* perforated in the center of the driven coupling 45, through which a second rotating shaft 48 connected to the photoconductor 41 and/or developing roller 43 is rotatably fitted, and a second fixing portion 45*d* to fix the driven coupling unit 45 to the second rotating shaft 48.

The second spherical portion 45*a* may come into contact with the other side of the inner surface of the cylindrical portion 122 of the coupling holder 120 in a state in which the driven coupling 45 is received in the coupling holder 120. The second spherical portion 45*a* controls or supports the driven coupling 45 to rotate with a degree of freedom inside the inner surface of the cylindrical portion 122 when the rotation center (I1, see FIG. 6) of the driving coupling 110 and the rotation center (I2, see FIG. 6) of the driven coupling 45 are not parallel or when the rotation center (I1, see FIG. 7) of the driving coupling 110 and the rotation center (I2, see FIG. 7) of the driven coupling 45 are offset from each other. In this way, connections between the driving coupling 110, the driven coupling 45 and the coupling holder 120 are maintained during power transmission.

The second protrusion 45*b* may be received and fitted in a receiving recess 124 of the coupling holder 120 in a state in which the driving coupling unit 110, driven coupling unit 45 and coupling holder 120 are coupled to each other, which allows the driven coupling unit 45 to rotate at the same angular velocity as that of the driving coupling unit 110. At least two second protrusions 45*b* may be arranged in a circumferential direction of the second spherical portion 45*a*.

The coupling holder 120 includes the cylindrical portion 122 into which the driving coupling 110 and driven coupling 45 are inserted through both sides thereof and are connected to each other, the at least one receiving recess 124 in which the first protrusion 114 and the second protrusion 45*b* are received, a support surface 126 to support one end of the elastic member 130, and a chamfer 128 provided at one end of the cylindrical portion 122 to control or support the coupling holder 120 to receive the driven coupling 45 when the coupling holder 120 and the driven coupling unit 45 are coupled to each other.

The hollow cylindrical portion 122 penetrates the center of the coupling holder 120 and has an inner diameter D corresponding to an outer diameter d1 of the first spherical portion 112 and an outer diameter d2 of the second spherical portion 45*a*, such that the driving coupling unit 110 and the driven coupling unit 45 are received in the cylindrical portion 122.

The cylindrical portion 122 includes the raised portion 123 stepped inward from the inner surface thereof. As described above, in cooperation with the first protrusion 114, the raised portion 123 prevents the coupling holder 120 from being separated from the driving coupling unit 110 as the driving coupling unit 110 is rotated upon receiving power from the drive source (not illustrated).

The receiving recess 124 has a shape corresponding to the first protrusion 114 and second protrusion 45*b* such that the first protrusion 114 and second protrusion 45*b* are received in the receiving recess 124. At least two receiving recesses 124 may be arranged in a circumferential direction of the cylindrical portion 122.

The chamber 128 is inclined from one end of the cylindrical portion 122 in a radius expanding direction of the cylindrical portion 122 to ensure that the coupling holder 120 smoothly receives the driven coupling 45. In particular, the chamfer 128 122 guides the driven coupling 45 to control or support the driven coupling 45 to smoothly enter into the cylindrical portion 122 along a slope 128*a* of the chamber 128 so as to be received in the cylindrical portion 122 when the rotation center (I1, see FIG. 6) of the driving coupling unit 110 and the rotation center (I2, see FIG. 6) of the driven coupling 45 are not parallel or when the rotation center (I1, see FIG. 7) of the driving coupling unit 110 and the rotation center (I2, see FIG. 7) of the driven coupling unit 45 are offset from each other.

Both ends 130*a* and 130*b* of the elastic member 130 are respectively supported by a second support portion 104 formed at an outer circumferential surface of the first rotating shaft 101 and the support surface 126 of the coupling holder 120, respectively. As such, the elastic member 130 acts to press the coupling holder 120 toward the driven coupling unit 45. The coupling holder 120 is pressed to the driven coupler 45 by the elastic member 130 and is supported by the first protrusion 114 and the second protrusion 45*b* received in the receiving recess 124 in a direction opposite to pressure applied to the coupling holder 120 by the elastic member 130, thereby being kept at a regulated axial position.

Figure 5:
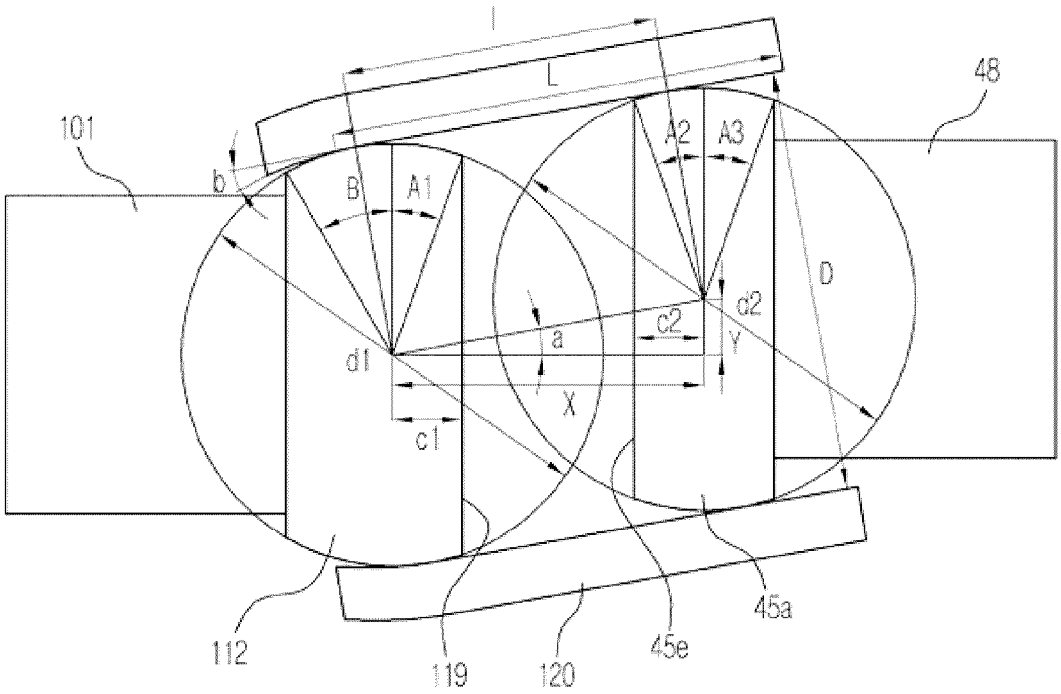
FIG. 5 is a view illustrating design parameters of the power-transmission assembly of FIG. 2.

FIG. 5 is a view illustrating design parameters of the power-transmission assembly of FIG. 2.

As illustrated in FIG. 5, design parameters and relationships between the design parameters to ensure that the driving coupling unit 110 and the driven coupling unit 45 are connected to each other via the coupling holder 120 and are rotatable at the same angular velocity when the rotation center (I1, see FIG. 6) of the driving coupling unit 110 and the rotation center (I2, see FIG. 6) of the driven coupling unit 45 are not parallel or when the rotation center (I1, see FIG. 7) of the driving coupling unit 110 and the rotation center (I2, see FIG. 7) of the driven coupling unit 45 are offset from each other are as follows.

The design parameters may be as follows.

X: a distance in an X-axis between a center of the first spherical portion 112 and a center of the second spherical portion 45*a*, Y: a distance in an Y-axis between the center of the first spherical portion 112 and the center of the second spherical portion 45*a*, a: angle $a=\tan^{-1}(Y/X)$ b=angle of the raised portion 123 with respect to a major surface of the cylindrical portion 122

A1: angle between a center line 112*a* of the first spherical portion 112 and a portion of the spherical surface of the first spherical portion 112, B: angle between the center line 112*a* of the first spherical portion 112 and a remaining portion of the spherical surface of the first spherical portion 112, A2: angle between a center line 45*a*1 of the second spherical portion 45*a* and a portion of the spherical surface of the second spherical portion 45*a*, A3: angle between the center line 45*a*1 of the second spherical portion 45*a* and a remaining portion of the spherical surface of the second spherical portion 45*a*, c1: the shortest distance between the center line 112*a* of the first spherical portion 112 and a first cut surface 119, c2: the shortest distance between the center line 45*a*1 of the second spherical portion 45*a* and a second cut surface 45*e*, d1: outer diameter of the first spherical portion 112, d2: outer diameter of the second spherical portion 45*a*, D: inner diameter of the cylindrical portion 122 of the coupling holder 120, L: length of a straight section of the cylindrical portion 122, and I: distance between the center of the first spherical portion 112 and the center of the second spherical portion 45*a*.

The design parameters may also be as follows.

$$A1=A2=A3>a\ a:a=\tan-1(Y/X) \quad (1)$$

$$B>a+b \quad (2)$$

$$X>2*(C1 \text{ or } C2) \quad (3)$$

$$L<1I2=X2+Y2 \quad (4)$$

$$d1=d2 \quad (5)$$

Here, X, Y and b are preset parameters depending on specifications of a drive unit of the image forming apparatus, i.e. drive torque, rotational speed, etc. A1 may be within a range from 10° or more to 30° or less, and B may be within a range from 10° or more to 45° or less.

When the aforementioned parameters satisfy the above relationships (1) to (5), the angular velocity of the driving coupling unit 110 and the angular velocity of the driven coupling unit 45 are maintained and stable power-transmission may be possible even when the rotation center (I1, see FIG. 6) of the driving coupling unit 110 and the rotation center (I2, see FIG. 6) of the driven coupling unit 45 are not parallel or when the rotation center (I1, see FIG. 7) of the driving coupling unit 110 and the rotation center (I2, see FIG. 7) of the driven coupling unit 45 are offset from each other are as follows.

Hereinafter, power-transmission from the driving coupling unit to the driven coupling unit when the rotation centers of the driving coupling unit and the driven coupling unit are dislocated will be described hereinafter.

Figure 6:
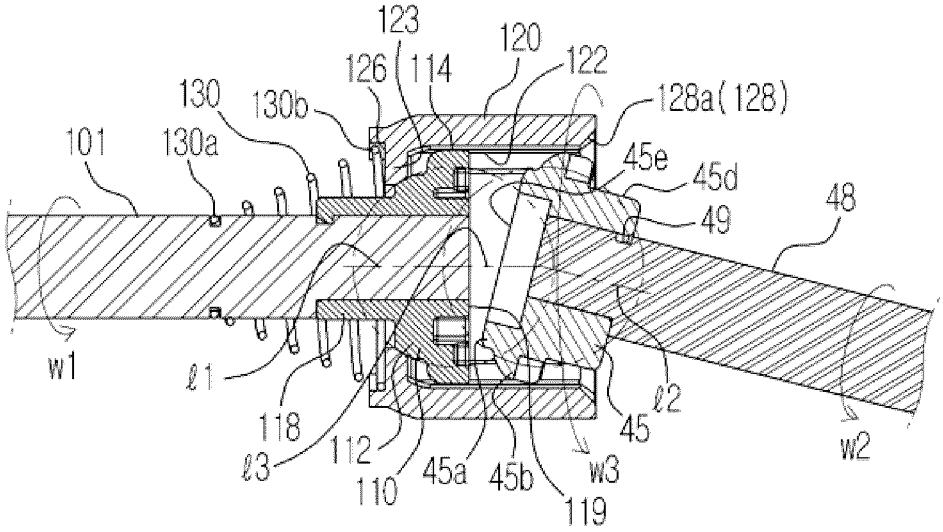
FIG. 6 is a view illustrating power-transmission through the coupling holder when rotation centers of the driving coupling and driven coupling are not parallel in the power-transmission assembly of FIG. 2.
Figure 7:
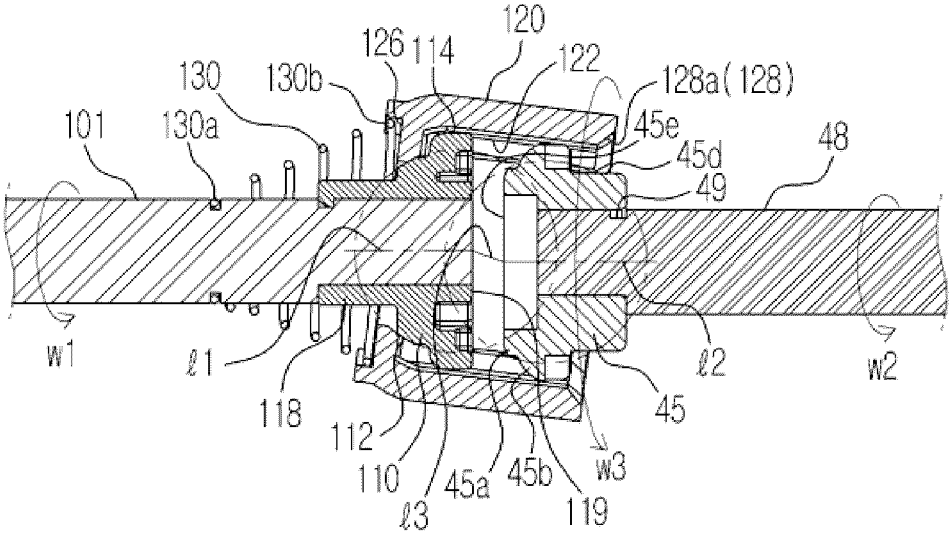
FIG. 7 is a view illustrating power-transmission through the coupling holder when rotation centers of the driving coupling and driven coupling are offset from each other in the power-transmission assembly of FIG. 2.

FIG. 6 is a view illustrating power-transmission through the coupling holder 120 when rotation centers of the driving coupling unit 110 and driven coupling unit 45 are not parallel in the power-transmission assembly, and FIG. 7 is a view illustrating power-transmission through the coupling holder 120 when rotation centers of the driving coupling unit 110 and the driven coupling unit 45 are offset from each other in the power-transmission assembly.

As illustrated in FIGS. 6 and 7, a drive power 10*b* is generated from a driving unit 10*c* and transmitted to the first rotating shaft 101. And then, the drive power 10*b* is transmitted from the first rotating shaft 101 to the driving coupling unit 110 coupled to the first rotating shaft 101, causing the driving coupling unit 110 to rotate at the same angular velocity w1 as that of the first rotating shaft 101.

Through a contact between the first spherical portion 112 of the driving coupling unit 110 and the inner surface of the cylindrical portion 122 of the coupling holder 120 and a pressure applied by the elastic member 130, the rotation center I1 of the driving coupling unit 110 and a rotation center I3 of the coupling holder 120 continuously maintain a concentric circle at various coupling angles. The coupling holder 120 is rotated in a state in which the first protrusion 114 of the driving coupling unit 110 is received in the receiving recess 124 of the coupling holder 120. As such, the angular velocity w3 of the coupling holder 120 is maintained equal to the angular velocity w1 of the driving coupling unit 110.

Through contact between the second spherical portion 45*a* of the driven coupling unit 45 and the inner surface of the cylindrical portion 122 of the coupling holder 120 and a pressure applied by the elastic member 130, the rotation center I2 of the driven coupling unit 45 and the rotation center I3 of the coupling holder 120 continuously maintain a concentric circle at various coupling angles. The coupling holder 120 is rotated in a state in which the second protrusion 45*b* of the driven coupling unit 45 is received in the receiving recess 124 of the coupling holder 120. As such, the angular velocity w3 of the coupling holder 120 is maintained equal to the angular velocity w2 of the driven coupling unit 45. Consequently, the driving coupling unit 110 and the driven coupling unit 45 are rotated at the same angular velocity.

The drive power 10*b* transmitted as described above is directed to the second rotating shaft 48 coupled to the driven coupling unit 45, thereby finally causing the photoconductor 41 and/or the developing roller 43 connected to the second rotating shaft 48 to be driven at a constant angular velocity.

As is apparent from the above description, according to the embodiments of the present general inventive concept, stable power-transmission may be accomplished even when rotation axes of a driving coupling unit and a driven coupling unit are dislocated.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus comprising:

a main body;

at least one driving coupling unit located in a side region of the main body, the at least one driving coupling unit being rotated by a drive power generated from a drive source;

at least one driven coupling unit connected to a rotator inside a developing cartridge mounted in the main body; and a coupling holder in which the at least one driving coupling unit and the at least one driven coupling unit are received and connected to each other to enable transmission of a rotation power from the at least one driving coupling unit to the at least one driven coupling unit, the coupling holder including a cylindrical inner surface, wherein the at least one driving coupling unit includes a first spherical portion having a first spherical surface configured to come into contact with one side of the inner surface of the coupling holder when received in the coupling holder, and wherein the at least one driven coupling unit includes a second spherical portion having a second spherical surface configured to come into contact with the other side of the inner surface of the coupling holder when received in the coupling holder.

2. The image forming apparatus of claim 1, wherein:

the at least one driving coupling unit includes at least one first protrusion radially protruding from the first spherical surface; and the coupling holder includes a raised portion stepped inward of the inner surface of the coupling holder so as to be caught by the at least one first protrusion, in order to prevent the coupling holder from being separated from the at least one driving coupling unit during rotation of the at least one driving coupling unit.

3. The image forming apparatus of claim 2, wherein:

the at least one driven coupling unit includes at least one second protrusion radially protruding from the second spherical surface; and the coupling holder includes at least one receiving recess having a shape corresponding to the at least one second protrusion to receive the at least one second protrusion, in order to ensure that the at least one driving coupling unit and the at least one driven coupling unit are rotatable at the same angular velocity.

4. The image forming apparatus of claim 3, wherein:

the second spherical portion includes at least two second protrusions arranged in a circumferential direction of the second spherical portion; and the receiving recess is arranged in a circumferential direction of the inner surface of the coupling holder such that the at least two second protrusions are received in the receiving recess.

5. The image forming apparatus of claim 3, wherein the raised portion of the inner surface of the coupling holder includes the at least one receiving recess.

6. The image forming apparatus of claim 1, further comprising:

an elastic member configured to come into contact with the coupling holder so as to axially press the coupling holder.

7. The image forming apparatus of claim 6, further comprising:

a rotating shaft coupled to the at least one driving coupling unit to rotate the at least one driving coupling unit, wherein the rotating shaft includes a support portion formed at an outer circumferential surface thereof to support one end of the elastic member.

8. The image forming apparatus of claim 1, wherein the first spherical portion and the second spherical portion have the same outer diameter.

9. The image forming apparatus of claim 1, wherein the coupling holder is rotated about a virtual axis that connects a center of the first spherical portion and a center of the second spherical portion during rotation of the at least one driving coupling unit.

10. The image forming apparatus of claim 1, wherein a distance between a center of the first spherical portion and a center of the second spherical portion is shorter than an axial length of the inner surface of the coupling holder.

11. The image forming apparatus of claim 1, wherein:

the first spherical portion includes a first cut surface to face the second spherical portion, and the second spherical portion includes a second cut surface to face the first cut surface; and a sum of the shortest distance between a center of the first spherical portion and the first cut surface and the shortest distance between a center of the second spherical portion and the second cut surface is shorter than a distance between the center of the first spherical portion and the center of the second spherical portion.

12. The image forming apparatus of claim 1, wherein the rotator includes a developing roller.

13. The image forming apparatus of claim 1, wherein the rotator includes a photoconductor.

14. A power-transmission assembly of an image forming apparatus, the assembly comprising:

at least one driving coupling unit to rotate about a first axis upon receiving a drive power generated from a drive source mounted in a main body of the image forming apparatus, the at least one driving coupling unit including a first spherical portion having a first spherical surface;

at least one driven coupling unit connected to a rotator inside a developing cartridge mounted in the main body, the at least one driven coupling unit being adapted to rotate about a second axis upon receiving a rotation power of the at least one driving coupling unit, the at least one driven coupling unit including a second spherical portion having a second spherical surface;

a coupling holder including a cylindrical portion in which the at least one driving coupling unit and the at least one driven coupling unit are received and connected to each other to achieve the same rotation angular velocity of the at least one driving coupling unit and the at least one driven coupling unit even if the first axis and the second axis do not coincide with each other, the coupling holder including a cylindrical inner surface configured to contact each of the first spherical surface and the second spherical surface; and an elastic member to axially press the coupling holder so as to regulate relative positions of the coupling holder, the at least one driving coupling unit and the at least one driven coupling unit in a state in which the at least one driving coupling unit and the at least one driven coupling unit are received in the cylindrical portion.

15. The power-transmission assembly of claim 14, wherein:

the at least one driving coupling unit includes a first spherical portion configured to come into contact with one side of an inner surface of the cylindrical portion when received in the cylindrical portion, and the at least one driven coupling unit includes a second spherical portion configured to come into contact with the other side of the inner surface of the cylindrical portion when received in the cylindrical portion.

16. The power-transmission assembly of claim 15, wherein:

the first spherical portion and the second spherical portion respectively include a first cut surface and a second cut surface facing each other; and a sum of the shortest distance between a center of the first spherical portion and the first cut surface and the shortest distance between a center of the second spherical portion and the second cut surface is shorter than a distance between the center of the first spherical portion and the center of the second spherical portion.

17. The power-transmission assembly of claim 15, wherein the first spherical portion and the second spherical portion have the same outer diameter.

18. The power-transmission assembly of claim 15, wherein a distance between a center of the first spherical portion and a center of the second spherical portion is shorter than an axial length of the cylindrical portion.

19. The power-transmission assembly of claim 15, wherein:

the at least one driving coupling unit includes at least one first protrusion to radially protrude from the first spherical surface; and the coupling holder includes a raised portion stepped inward of the inner surface of the cylindrical portion so as to be caught by the at least one first protrusion.

20. The power-transmission assembly of claim 15, wherein:

the at least one driven coupling unit includes at least one second protrusion radially protruding from the second spherical surface; and the coupling holder includes at least one receiving recess having a shape corresponding to the at least one second protrusion to receive the at least one second protrusion.

21. The power-transmission assembly of claim 14, wherein the cylindrical portion includes a chamfer to assist the at least one driven coupling unit to be smoothly received in the cylindrical portion.

22. An image forming apparatus comprising:

a main body and a developer cartridge installed in the main body;

a driving coupling unit disposed on a side region of the main body, the driving coupling unit being rotated about a first rotation center line by a drive power generated from a drive source, the driving coupling unit including a first spherical portion having a first spherical surface;

a driven coupling unit disposed on the developer cartridge and having a second rotation center line, the driven coupling unit including a second spherical portion having a second spherical surface;

a coupling holder to connect the driving coupling unit and the driven coupling unit when the developer cartridge is installed in the main body, and to transmit the drive power from the driving coupling unit to the driven coupling unit when the first center line and the second center line are not disposed on a same line, the coupling holder including a cylindrical inner surface configured to contact each of the first spherical surface and the second spherical surface.

23. The image forming apparatus of claim 22, further comprising:

a first coupling element formed to fixedly couple the driving coupling unit and the coupling holder; and a second coupling element formed to movable couple the driven coupling unit and the coupling holder.

24. The image forming apparatus of claim 22, wherein:

the driven coupling unit of the developer cartridge comprises a rotation shaft and a spherical portion forming on a distal end of the rotation shaft to be inserted into the coupling holder; and the spherical portion of the driven coupling unit is moveably coupled to the coupling holder to allow a movement of the second rotation center within the coupling holder during the transmission of the drive power.

* * * * *